United States Patent [19]

Moritani

[11] 4,179,853

[45] Dec. 25, 1979

[54] CONTROLLING DEVICE FOR GRINDING PIEZO-ELECTRIC ELEMENT

[75] Inventor: Nakanobu Moritani, Tokyo, Japan

[73] Assignee: Kabushiki Kaisha Seikosha, Japan

[21] Appl. No.: 831,275

[22] Filed: Sep. 7, 1977

[51] Int. Cl.[2] ..... B24B 49/10

[52] U.S. Cl. ..... 51/165 R; 324/56

[58] Field of Search ..... 318/607; 324/56; 51/165 R, 165.74, 165.75, 165.76, 165.77

[56] References Cited

U.S. PATENT DOCUMENTS

| | | | |
|---|---|---|---|
| 2,023,494 | 12/1935 | Strieby | 51/165 R |
| 2,476,954 | 7/1949 | Blackburn | 324/56 |
| 3,395,494 | 8/1968 | Sogn | 51/165 R |
| 3,521,166 | 7/1970 | Grayzel | 324/56 |

*Primary Examiner*—Harold D. Whitehead

*Attorney, Agent, or Firm*—Robert E. Burns; Emmanuel J. Lobato; Bruce L. Adams

[57] ABSTRACT

A controlling device which takes out an electrical signal including, as its component, a natural frequency that is produced with grinding of a piezo-electric element, and makes the signal pass through two filters possessing equivalent damping amount at a desired natural frequency so as to bring the grinding operation to a stop when the dc conversion outputs of both filters coincide with each other.

4 Claims, 6 Drawing Figures

CONTROLLING DEVICE FOR GRINDING PIEZO-ELECTRIC ELEMENT

BACKGROUND OF THE INVENTION

The present invention relates to a device for detecting and controlling a desired grinding condition of a piezoelectric element. More particularly, the device is designed to detect a desired natural frequency, employing two filters which provide equivalent damping amount at a desired natural frequency of a piezo-electric element.

In conventional grinding of a crystal piece for obtaining a specified natural frequency, crystal pieces are first mounted on a grinding apparatus to undergo rough grinding for a period that has been measured in advance, and each crystal piece is then taken out to make measurement of the individual natural frequency. When the frequency proves not to have reached a specified natural frequency, re-grinding is carried out. Therefore, it requires longer time for adjustment, and requires much labor since each crystal piece has to be taken out every time measurement of the frequency is made.

SUMMARY OF THE INVENTION

The present invention is to provide a new controlling device for grinding piezo-electric elements, eliminating the conventional disadvantages described above.

The major feature of the present invention is to take out an electrical signal including, as its component, a natural frequency produced at the time of grinding a piezo-electric element and then make the signal pass through the filters which provide equivalent damping amount at a desired natural frequency to convert it into dc voltage and the dc conversion outputs of the both filters are compared, so as to stop the grinding operation when they coincide with each other.

The first object of the present invention is to provide a new controlling device for grinding piezo-electric elements, which is capable of properly stopping the grinding operation when a desired grinding condition of a piezo-electric element has been obtained.

The second object of the present invention is to take out an electrical signal including, as its component, a natural frequency produced in accordance with the grinding condition of a piezo-electric element, and then to detect coincidence of the dc conversion outputs of the both filters, employing two filters which provide the equivalent damping amount at a desired natural frequency of piezo-electric element so as to stop the grinding operation, thereby providing a piezo-electric element with a desired natural frequency without an error in the selection of frequency caused by variation in the input of an electrical signal fed to the filters.

The third object of the present invention is to detect an electrical signal including, as its component, a natural frequency produced at the time of grinding a piezo-electric element, and then make the signal pass through two filters possessing equivalent damping amount at a desired natural frequency to stop the grinding operation by means of the coincident dc conversion outputs from the both filters, obtained after the lapse of a specified time from the beginning of grinding, thus providing a piezo-electric element with a desired natural frequency, eliminating spurious frequencies which coincide with the desired natural frequency.

BRIEF DESCRIPTION OF THE DRAWINGS

The nature of the present invention as well as other objects and advantages thereof will become more apparent from consideration of the following detailed description and the accompanying drawing in which.

DESCRIPTION OF THE PREFERRED EMBODIMENTS

Description of a preferred embodiment of the present invention is given with reference to the drawings.

Figure 1:
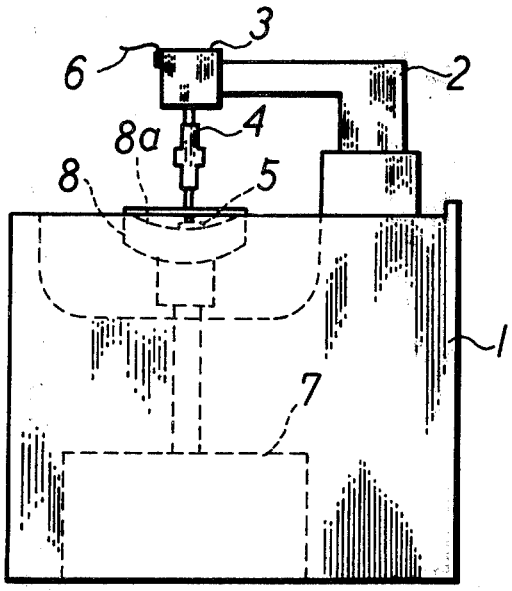
FIG. 1 is an illustrative front view of a known grinding apparatus.

FIG. 1 shows an outline of a known grinding apparatus.

In the said drawing, an arm 2 is fixed on a conductive pedestal 1, and a driving mehanism 3 is mounted on one end of the arm 2. A conductive fixture 5 for mounting a crystal element is provided on the tip of a conductive shaft 4 which is rotated by the driving mechanism 3. A lead wire 6 which has been led out from a part of the driving mechanism 3 takes out electrical signals produced at the time of grinding crystal elements. A driving mechanism 7 enclosed in the pedestal 1 is designed to rotate and shake a conductive concave-surface lapping machine 8, and a crystal element 4 is ground by a concave grinding surface 8*a* thereof. The lapping machine 8 is electrically connected to the pedestal 1.

Figure 2:
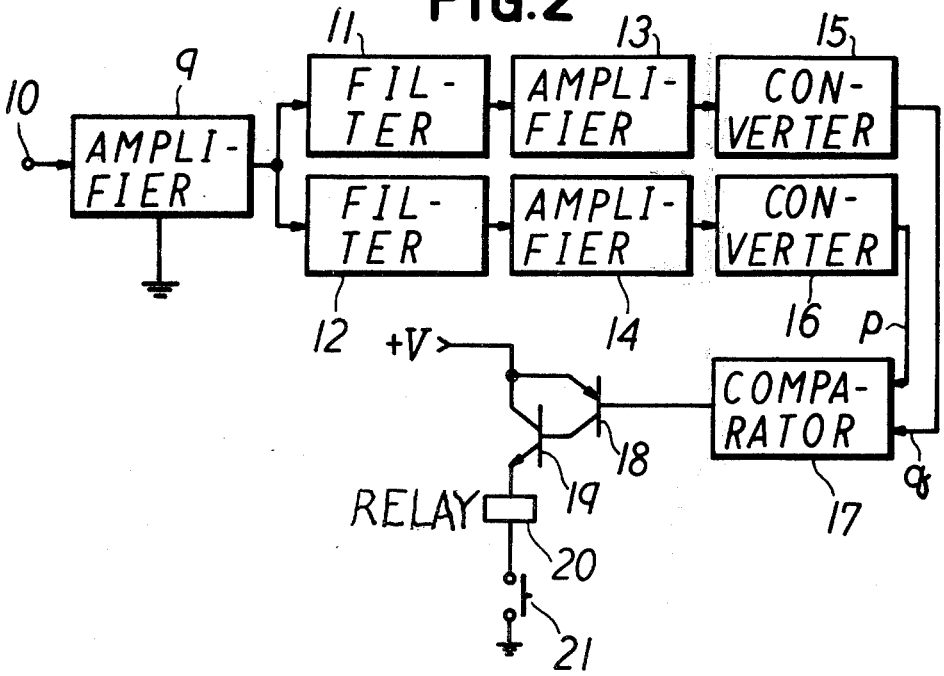
FIG. 2 is a systematic diagram of the electric circuit for controlling the grinding apparatus according to one of the preferred embodiments of the present invention.
Figure 3:
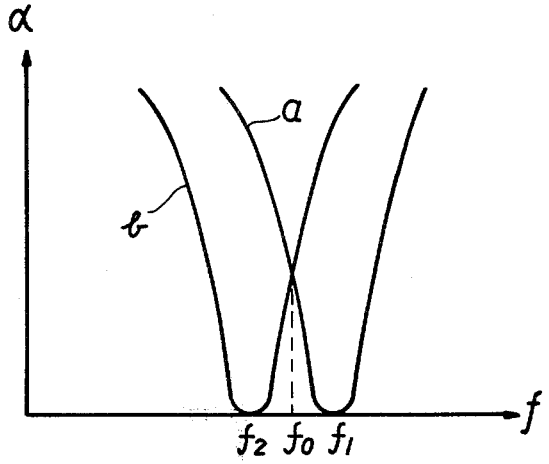
FIG. 3 is a characteristic curve diagram showing the frequency f vs. damping amount $\alpha$ of the filters in FIG. 2.

In FIG. 2, the lead wire 6 in FIG. 1 is connected to an input terminal 10 of an amplifier 9, and an output terminal thereof is supplied to band-pass filters 11 and 12. The band-pass filters 11 and 12 have been set in such a manner that they exhibit the damping characteristics shown in FIG. 3. In FIG. 3, the axis of abscissas shows the frequency f, while the axis of ordinates indicates the damping amount $\alpha$. A curve a indicates the characteristic of the band-pass filter 11 having a frequency $f_1$ as the central frequency of the band, which is higher than a desired natural frequency fo resulting from the grinding of the crystal element 4. A curve b represents the characteristic of the band-pass filter 12 having a frequency $f_2$ as the central frequency of the band, which is lower than the natural frequency fo. As may be apparent from the diagram, the curves a and b have equivalent damping amount at the natural frequency fo. The output terminals of the filters 11 and 12 are connected to dc converters 15 and 16, respectively, through amplifiers 13 and 14, and each output is fed to terminals P and q of a comparator 17 so that a logical value "1" is produced when the voltage level of the input terminal q is above that of the input terminal P. The outputs of the comarator 17 are supplied to the transistors 18 and 19, and the grinding apparatus shown in FIG. 1 is supplied with power to start its grinding operation when the transistor 19 is turned on. A manually-operated switch 21 is used to commence the operation.

Figure 4:
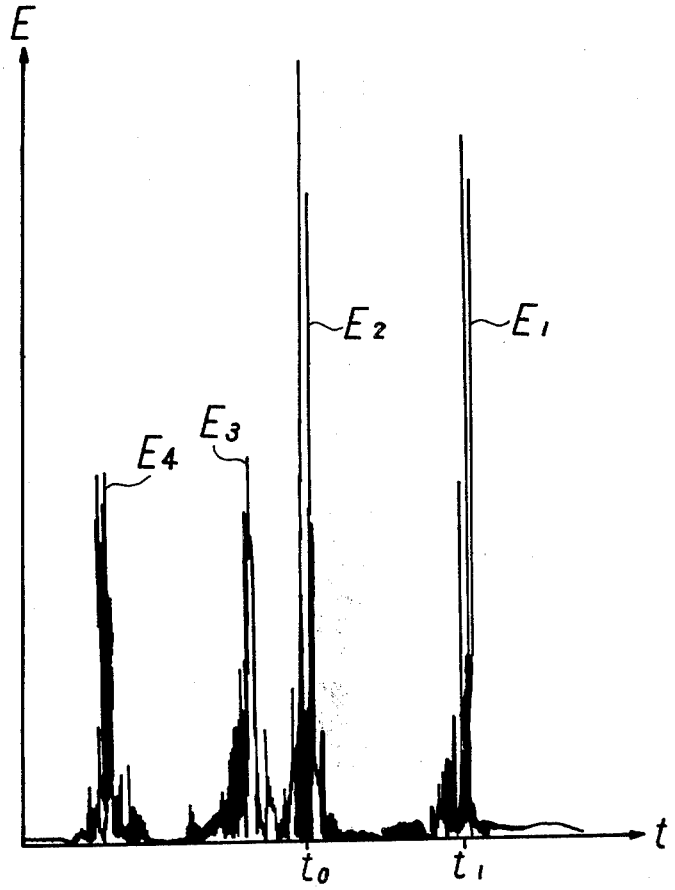
FIG. 4 is a characteristic diagram showing grinding time t vs. voltage E at the time of grinding a crystal element.

Now, description is given for the operation. A crystal element to be mounted on the fixture 5 shown in FIG. 1 shall have completed rough grinding and have the specified thickness. The reason for this may be explained by the actual measurement which has proved that during the grinding operation to produce the thickness required for generating a desired natural frequency of a crystal element, a variety of spurious frequencies are generated and the same frequency component with that of a desired natural frequency is found among these spurious frequencies. This state is shown in the characteristic diagram of FIG. 4 wherein the axis of abscissas represents grinding time t, while the axis of ordinates indicates voltage E at the time when the amplified signal of each frequency generated at the lead wire 6 is made pass through a band-pass filter having a desired natural frequency fo as its central frequency. Spurious frequencies fo represented by voltages E4, E3, and E2 are generated before voltage E1 of the natural frequency fo at the time $t_1$ is obtained. Therefore, the crystal element used in the present embodiment has been ground in advance to an extent between the time $t_1$, and time $t_0$ immediately before the frequency fo is generated. The time $t_0$ has some variation, depending upon each crystal element, however, the frequency fo which is to be produced next provides a desired natural frequency if the grinding has been performed for max. period during which said variation may possibly be found. The crystal element that has been ground to such thickness is mounted on the fixture 5.

Referring to FIG. 2, the comparator 17 maintains an output condition of the logical value "0" in the initial state. Now, when the manually-operated switch 21 is closed to turn on the transistors 18 and 19, a relay 20 activates, driving the grinding apparatus into operation. With this grinding operation, signals comprising the natural frequency of the crystal element and other frequency components are generated at the lead wire 6. The signals comprising various frequency components like these are amplified by the amplifier 9 and they are fed to the filters 11 and 12. As shown in FIG. 3, the damping amounts $\alpha$ of the filters 11 and 12, respectively, differ at frequencies except the frequency fo, so that dc voltages converted by the dc convertors 15 and 16, respectively, are different. As the grinding time lapses, the natural frequency increases, and when it has slightly exceeded the natural frequency fo, the logical value of the comparator 17 is reversed to "1," turning the transitors 18 and 19 off. Then, the relay 20 is switched off and the grinding apparatus is consequently brought to a stop. Thus, the frequency fo is detected by the two filters 11 and 12 providing equivalent damping amount at the frequency fo so that the dc conversion values at the frequency fo will coincide regardless of variation in the output level of the amplifier 9 since the output levels of both filter circuits 11 and 12 will be also varied in accordance with said variation. Accordingly, the operation is not subjected to a fluctuation even if the input levels of the filters are varied, permitting highly accurate detection of the desired frequency.

As described above in detail, the present embodiment is designed to take out electrical signals including natural frequencies which are generated at the time of grinding crystal elements, and then make the signals pass through filters sharing the equivalent damping amount at a desired natural frequency so as to bring the grinding apparatus to a stop when the filters coincide with each other in their output dc conversion values. Therefore, it is possible to detect automatically and assuredly that a crystal element has been ground and a desired natural frequency has been reached and then stop the grinding apparatus without any human help, independently of the variation in the electric signals.

Figure 5:
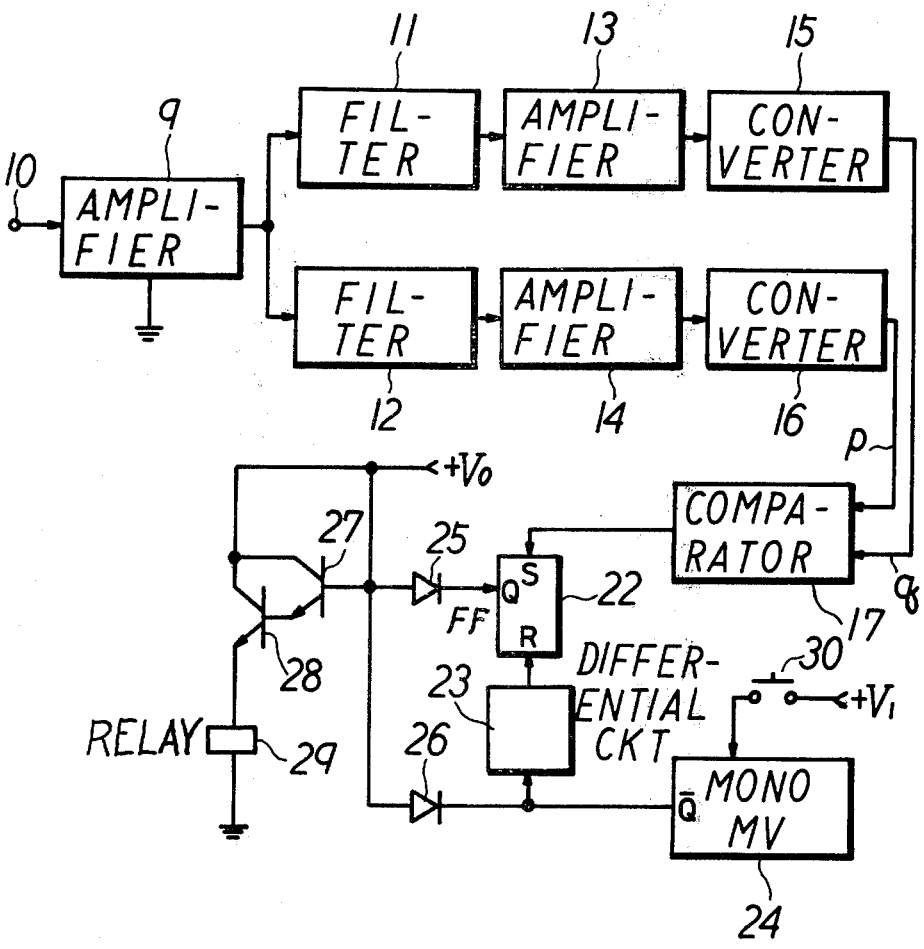
FIG. 5 is a systematic diagram of an electric circuit showing another embodiment of the present invention.

Now, description of another embodiment of the present invention is made, referring to FIG. 5. The same reference numbers as in FIG. 2 indicate the same elements. A flip-flop circuit 22 is set by a coincident output of the comparator 17, and is reset by means of a signal which is differentiated by a differential circuit 23 when the timing device, a mono-multivibrator 24, is reversed from a low level to a high level. The reference numerals 25 and 26 represent diodes, and, 27 and 28, transistors. A relay 29 is set in such a manner that it keeps the grinding apparatus shown in FIG. 1 to remain off while it is maintained to be on, but drives the apparatus into operation when it is switched off. A reference numeral 30 represents a manually-operated switch of selfresetting type.

Figure 6:
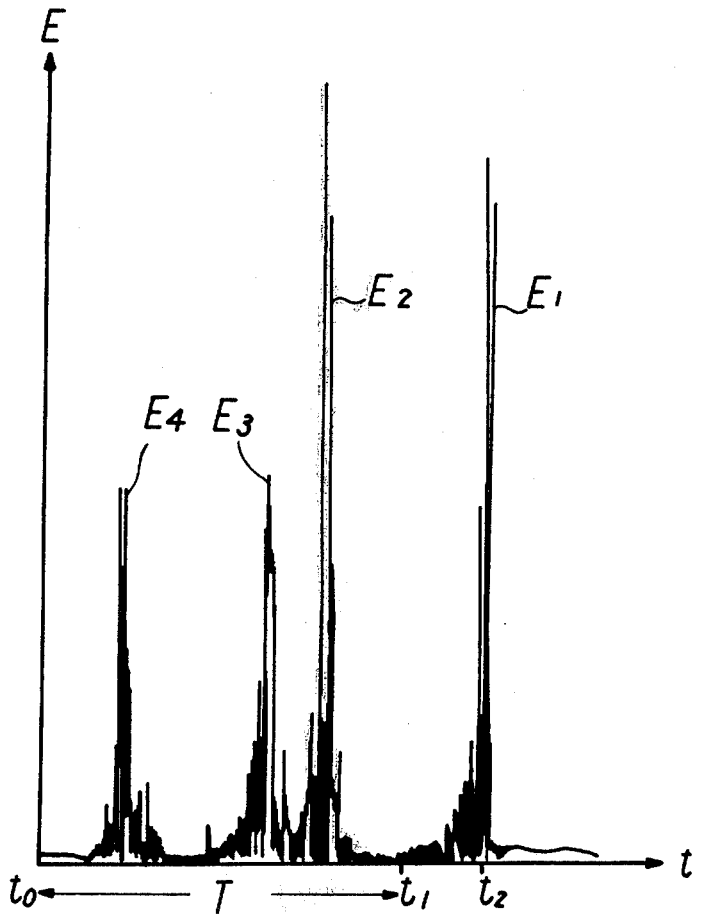
FIG. 6 is a characteristic curvilinear diagram showing grinding time t vs. voltage E at the time of grinding a crystal element.

The operation of the present embodiment is described hereinafter. Description of the operations for reaching the comparator 17 illustrated in FIG. 5 is omitted since it is the same with that of the prior embodiment. To provide description of the operation, consider that the flip-flop circuit 22 is set in the initial state, and the mono-multivibrator 24 is held at a high level output. Consequently, the transistors 27 and 28 are on with the relay 29 being also on, and the grinding apparatus shown in FIG. 1 continues to be stopped. When the manually-operated switch 30 is closed, the mono-multivibrator 24 activates, causing its output $\overline{Q}$ to be reversed from a high level to a low level. As a result, the transistors 27 and 28 are turned off, which is followed by the relay 29 being turned off, and the grinding apparatus illustrated in FIG. 1 is supplied with power to start grinding. During the period from the starting of grinding operation till the crysral element 4 has been ground to the desired thickness, spurious frequency components which are the same as the desired natural frequency fo are generated. The generation state of the spurious frequencies fo is as shown in FIG. 6 wherein the axis of abscissas represents time t, while the axis of ordinates indicates voltage E. This characteristic is just as described in the prior embodiment. Referring to FIG. 6, the voltages $E_1$–$E_4$ due to the spurious frequencies fo are generated during the period from the starting time $t_0$ of the grinding to the time $t_1$ immediately before the desired natural frequency fo is produced. Therefore, the time T during the period from the time $t_0$ to the time $t_1$ is measured in advance so as to hold the output level of the mono-multivibrator 24 at a low level for a period corresponding to the time T. Thus, after the manually-operated switch 30 is closed, the transistors 27 and 28 are kept off with the relay 29 also being kept off until the time T lapses so that the grinding apparatus does not stop its operation even if the spurious frequencies fo arrive during this period.

When the time T has lapsed, the output $\overline{Q}$ of the mono-multivibrator 24 is reversed to a high level, and the flip-flop circuit 22 is reset by the differentiated output, causing its output Q to be reversed to a low level. After that, when the natural frequency of the crystal element 4 has reached fo, the inputs P and q of the comparator 17 will become equal, and its output will provide a logical value "1," setting the flip-flop circuit 22. Accordingly, the output Q will be of a logical value "1," and as a result, the transistors 27 and 28 are turned on, and the relay 29 is consequently turned on, thereby bringing the grinding apparatus in FIG. 1 to a stop, which completes the grinding.

In the present embodiment, elimination of the spurious frequencies is ensured and therefore an intended natural frequency is assuredly obtained even when grinding is started with a rough grinding condition, which may add to the effect of the prior embodiment.

Description is limited to a crystal element in the above embodiments, however, the piezo-electric element may also be lithium tantalate, barium titanate, etc.

What we claim is:

1. Controlling device for grinding piezo-electric elements comprising:

grinding apparatus for grinding a piezo-electric element to obtain a desired natural frequency, two band-pass filters of which one has a central frequency of the band which is lower than the desired natural frequency of said piezo-electric element and the other has a central frequency of the band which is higher than the desired natural frequency of said piezo-electric element, said filters having equal damping characteristics at the desired natural frequency of said piezo-electric element, means for detecting an electric signal from the piezo-electric element being ground including as a frequency component the natural frequency of said element and feeding said signal to an input of each of said band-pass filters, means for converting the output of each of said two band-pass filters to a dc voltage, comparator means receiving said dc voltages from said converting means and detecting whether or not said dc voltages coincide, and means for stopping the grinding of said piezo-electric crystal by said grinding apparatus in response to a predetermined signal from said comparator means.

2. Controlling device for grinding piezo-electric elements according to claim 1, further comprising timing means for preventing the stopping of said grinding of said piezo-electric element until the elapse of a predetermined time period after the start of grinding.

3. Controlling device for grinding piezo-electric elements according to claim 2, in which said means for stopping the grinding comprises a flip-flop circuit which is reset in response to a predetermined output of said timing means and is set in response to said predetermined signal from said comparator means, means for detecting whether or not said timing means produces said predetermined output and said flip-flop circuit is reset and set, and transistor circuit means for stopping operation of said grinding apparatus in response to detection of an output generated from said detection means when said flip-flop circuit has been set.

4. Controlling device for grinding piezo-electric elements according to claim 2, in which said timing means comprises a mono-multivibrator.

* * * * *